United States Patent [19]

Tanaka et al.

[11] Patent Number: 4,629,528

[45] Date of Patent: Dec. 16, 1986

[54] LABELING MACHINE

[75] Inventors: Hideo Tanaka, Kanazawa; Toshiaki Naka, Tatsunokuchimachi; Shiaru Muranaka; Yoshikazu Miyashita, both of Kanazawa, all of Japan

[73] Assignee: Shibuya Kogyo Co., Ltd., Ishikawa, Japan

[21] Appl. No.: 582,116

[22] Filed: Feb. 21, 1984

[30] Foreign Application Priority Data

Feb. 24, 1983 [JP] Japan ..... 58-29887

[51] Int. Cl.[4] ..... B65C 9/18; B65C 9/44

[52] U.S. Cl. ..... 156/351; 83/371; 156/354; 156/355; 156/361; 156/364; 156/378; 156/384; 156/455; 156/521; 156/567; 156/568; 156/DIG. 26; 156/DIG. 33; 156/DIG. 46

[58] Field of Search ..... 156/354, 355, 361, 364, 156/521, 568, 567, DIG. 33, DIG. 45, DIG. 46, 353, 366, 378, 384, 449, 455, 517, DIG. 26, 351; 83/71, 208, 371

[56] References Cited

U.S. PATENT DOCUMENTS

| | | | |
|---|---|---|---|
| 3,108,032 | 10/1963 | Carlson | 156/361 |
| 3,539,414 | 11/1970 | Lefort | 156/364 |
| 3,565,724 | 2/1971 | Yamaguchi | 156/355 |
| 3,594,257 | 7/1971 | Von Hofe | 156/361 |
| 3,713,948 | 1/1973 | Kluger | 156/355 |
| 3,955,481 | 5/1976 | Heitmann | 156/521 |
| 3,989,577 | 11/1976 | Watson | 156/568 |
| 4,397,709 | 8/1983 | Schwenzer | 156/378 |
| 4,519,868 | 5/1985 | Hoffmann | 156/353 |

*Primary Examiner*—Michael Wityshyn

*Attorney, Agent, or Firm*—Alan H. MacPherson; Steven F. Caserza; Kenneth E. Leeds

[57] ABSTRACT

A roll labeler for labeling containers one by one automatically is provided. A label sheet is supplied as uncoiled from a roll over a predetermined length and the label sheet is cut by a cutter thereby producing a cut sheet of label which is then glued while being transported and attached to the corresponding container. The labeler includes a feed roller for feeding the label sheet to the cutter intermittently and a mechanism for transporting containers to be labeled along a container transportation path. The labeler also includes a pair of driving sources: one driving source for driving the feed roller and the other driving source for driving the container transporting mechanism.

14 Claims, 3 Drawing Figures

LABELING MACHINE

BACKGROUND OF THE INVENTION

1. Field of the Invention

This invention relates to a labeling machine for automatically glueing labels to containers such as bottles and cans and particularly to a roll labeler or labeling machine of the type in which a label sheet in the form of a roll is unwound, cut and glued to a container. More specifically, the present invention relates to a roll labeler in which a label sheet unwound from a roll is intermittently supplied to a cutting section where the label sheet is cut into a desired size, and the label thus cut is glued to a container which is being transported by a container transporting mechanism.

2. Description of the Prior Art

In some prior art roll labelers, a label sheet unwound from a roll is intermittently supplied to a cutting section by a feeding mechanism, where a label having a desired shape and size is cut from the label sheet. In such roll labelers, typically, the label sheet is provided with registration marks which are detected to produce detection signals while the label sheet is being supplied by the feeding mechanism. In response to each of such detection signals, there is generated a feed stop command signal which causes the feeding mechanism to stop supplying the label sheet.

In the above-described prior art roll labelers, however, a time interval from the generation of a stop feed command signal to the actual stoppage of the label sheet is fixed. Accordingly, if the transportation speed for transporting containers to be labeled along a predetermined transportation path varies, the feeding speed of the label sheet also varies in response thereto, which, in turn, causes the supplied amount, or length, of label sheet to vary during the time interval between the generation of the feed stop command signal and the stoppage of supply of the label sheet. As a result, for example, during a start-up mode in which the operational speed gradually changes from a low level to a high level, the timing to generate a feed stop command signal in response to the direction signal must be suitably adjusted in association with the transporting speed of containers and thus the operational speed of the roll labeler.

For this reason, in the prior art roll labelers, typically, the operational speed of the roll labeler is monitored and the above-mentioned timing is suitably adjusted in accordance with the level of the operational speed of the roll labeler. With such a structure, however, it is necessary to adjust such timing in a continuous manner in accordance with changes in the operational speed, and optimum adjustment of such timing over the entire range of operational speed is not always easy.

SUMMARY OF THE INVENTION

It is therefore a primary object of the present invention to provide an improved labeling machine.

Another object of the present invention is to provide an improved labeling machine of the type in which a label sheet unwound from a roll is cut to a desired size and the thus cut label is fixedly attached to a container.

A further object of the present invention is to provide a roll labeler which does not require adjustment of timing in generating a feed stop command signal in response to a detection signal as required in the prior art roll labelers.

A still further object of the present invention is to provide a roll labeler which is highly reliable in operation, easy in maintenance, flexible in applications.

Other objects, advantages and novel features of the present invention will become apparent from the following detailed description of the invention when considered in conjunction with the accompanying drawings.

DESCRIPTION OF THE PREFERRED EMBODIMENTS

Figure 1:
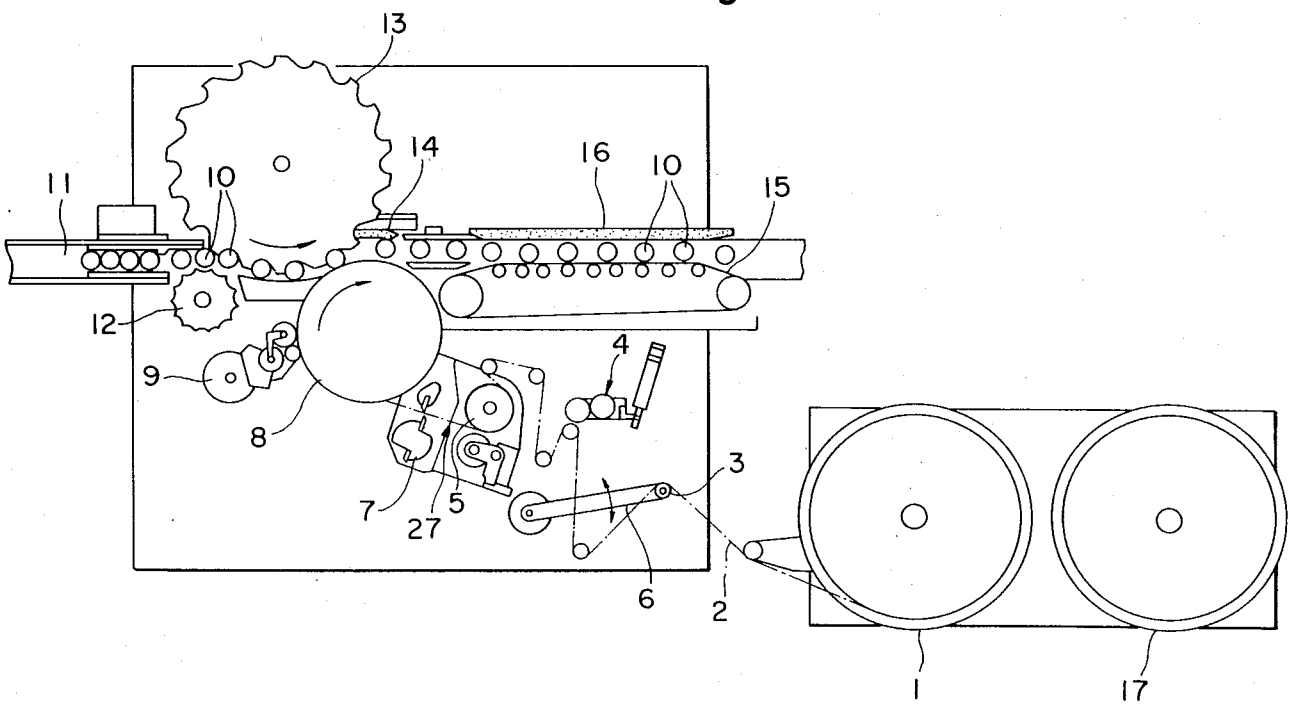
FIG. 1 is a schematic illustration in plan view showing the overall structure of the labeling machine constructed in accordance with one embodiment of the present invention.

Referring now to FIG. 1, there is shown a roll labeler constructed in accordance with one embodiment of the present invention and it includes a roll 1 of label sheet 2. The label sheet 2 unwound from the roll 1 and thus continuous in the form of a belt is supplied to a feed roller 5 after passing around a plurality of rollers, including a tension roller 3, as indicated by the one-dotted line. The tension roller 3 is rotatably supported at the tip end of a tension arm 6 which is pivotally supported as indicated by the double-headed arrow. The tension arm 6 is normally biased in the counterclockwise direction, for example, by a spring to maintain the label sheet extending between the roll 1 and the feed roller 5 in a predetermined tension state. A printer 4 is disposed along the passage of label sheet 2 from the roll 1 to the feed roller 5 so that desired data such as lot number and date of manufacture may be printed on the surface of label sheet 2.

From the feed roller 5, the label sheet 2 is supplied to a rotary cutter 7 where the label sheet 2 is cut to produce a cut sheet of label having a desired length, which is then attracted to an application drum 8 with its front surface in contact with the peripheral surface of the drum due to suction. Since the application drum 8 is in rotation in the direction indicated by the arrow, the cut sheet of label is transported on the peripheral surface of the drum 8. There is provided a glue applying device 9 adjacent to the application drum 8 so that glue is applied to the back side of the cut sheet of label carried on the peripheral surface of the drum 8 as attracted thereto by suction. The cut sheet of label now having glue on its back surface is then applied to a container 10 which is being transported along a predetermined transportation path as will be described more in detail below, so that the container 10 is properly labeled.

Containers 10 are transported from the left to the right in FIG. 1 on a conveyor belt 11 which basically defines the transportation path of containers 10. Adjacent to the conveyor belt 11 is disposed a stopper wheel 12 which prevents too many containers 10 from being transported at a time. Also disposed adjacent to the conveyor belt 11 and in the immediate downstream of the stopper wheel 12 is a star wheel 13 which is provided with a plurality of notches along its periphery at equal intervals. The star wheel 13 is driven to rotate counterclockwise as indicated by the arrow thereby causing the containers 10 to be spaced apart one from another over a predetermined distance on the conveyor belt 11 in association with the rotation of the application drum 8. Thus, as described above, the containers 10 are labeled as they are brought into contact with the application drum 8 while being transported.

An outlet pressure pad 14 is provided immediately downstream of the star wheel 13 and spaced apart over a predetermined distance from the peripheral surface of the application drum 8 across the belt conveyor 11. Accordingly, the containers 10 released from the star wheel 13 are transported between the application drum 8 and the outlet pressure pad 14 while rolling along the pressure pad 14 whereby the cut sheet of label is placed around the container 10 under pressure. Further downstream is provided an elongated pressure pad 16 extending along one side of the conveyor belt 11 over a predetermined distance. An endless belt 15 is provided as extended between a pair of rollers with its going run located opposite to and spaced apart from the pad 16 across the conveyor belt 11. The endless belt 15 is also driven to rotate such that its going run moves in the same direction as that of the conveyor belt 11. Thus, the containers 10 roll along the elongated pad 16 while being transported as sandwiched between the pad 16 and the belt 15, so that cut sheets of label are firmly and fixedly attached to containers 10.

Adjacent to the roll 1 is disposed another roll 17 of label sheet which is to be used after the roll 1 has all been used. That is, when the remaining amount of roll 1 has become scarce after having been used some time, the trailing end of label sheet of roll 1 is connected to the leading end of label sheet of roll 17 manually or by a roll labeler connector well known to one skilled in the art.

Figure 2:
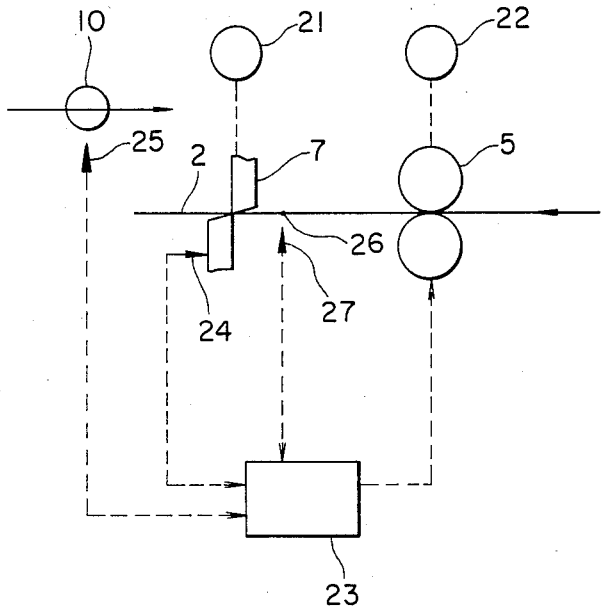
FIG. 2 is a block diagram showing the operative relation between main elements of the labeling machine shown in FIG. 1.

As shown in FIG. 2, there is also provided a first motor 21 which is connected to drive the rotary cutter 7. It is to be noted that the first motor 21 is also connected to drive other components such as drum 8 and star wheel 13 synchronously excepting the feed roller 5. A second motor 22 such as a stepping motor, servo motor and pulse motor is provided exclusively to drive the feed roller 5 so that the feed roller 5 may be driven to rotate independently of the driving condition of the first motor 21.

Also as shown in FIG. 2, a detector 24 is provided adjacent to the rotary cutter 7 so as to detect the operating condition thereof and another detector 25 is provided at an appropriate position along the path for transporting the containers 10 to be labeled for detecting the presence or absence of the containers 10. These detectors 24 and 25 are connected to supply detection signals to a controller 23 which controls the feeding of label sheet 2. That is, in response to detection signals from the detectors 24 and 25, the controller 23 determines whether or not the label sheet from the roll 1 is to be supplied, and, if affirmative, it supplies a drive signal to the feed roller 5 which is thus driven to rotate thereby supplying the label sheet as unwound from the roll 1.

Figure 3:
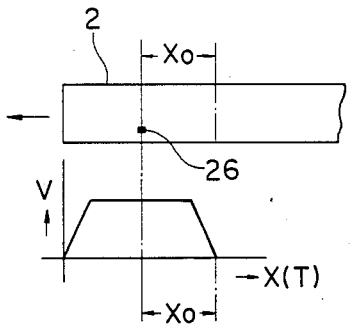
FIG. 3 is a schematic illustration showing the relation between a distance from a registration mark on a label sheet to a severing position and the feed speed of the label sheet.

Also as shown in FIG. 2, there is provided a further detector 27 disposed at an appropriate position along the travelling path of the label sheet 2 from the roll 1 to the rotary cutter 7 for detecting registration marks provided on the label sheet unrolled from the roll 1. When detecting a registration mark, the detector 27 supplies a detection signal to the controller 23 which then causes the feed roller 5 to stop the supply of label sheet 2 after a given time has elapsed. Described more in detail, upon receipt of a detection signal supplied from the detector 27, a counter provided in the controller 23 starts to count after having been reset. Then, when the counter has reached a count which has been previously determined in accordance with a distance $X_0$ from the registration mark 26 on the label sheet 2 to a severing position where the label sheet 2 should be cut by the rotary cutter 7 (FIG. 3), the controller 23 causes the feed roller 5 to stop its operation. The controller 23 controls the feeding of label sheet 2 in the manner shown in the graph of FIG. 3 whose abscissa represents the distance X or time T and whose ordinate represents the velocity of label sheet 2. Thus, when the feed roller 5 starts to be driven, the label sheet 2 is accelerated to a predetermined feeding velocity linearly which is then maintained during the supply of label sheet 2. On the other hand, when the supply of label sheet 2 is to be stopped, the feeding velocity of label sheet 2 is decelerated linearly. As an alternative, as soon as the controller 23 receives a detection signal supplied from the detector 27, the predetermined count as mentioned above is set in the counter and the count is gradually decremented to zero where the feed roller 5 is deactivated.

With the above-described structure, in the condition at the time when the rotary cutter 7 has just severed the label sheet 2, the feed roller 5 which is driven by the second motor 22 is in the inoperative condition; on the other hand, the other components such as the rotary cutter 7 and the mechanism for transporting containers 10 which are driven by the first motor 21 are still in operation so that the cut sheet of label is transported and glued to the corresponding container 10. By this time, the detector 25 has already detected the condition as to presence or absence of the next container 10 to be labeled so that its detection signal has already been input to the controller 23.

Then, as soon as the detector 24 detects the fact that the rotary cutter 7 has severed the label sheet 2, the detector 24 supplies a detection signal to the controller 23 which then causes the feed roller 5 to initiate its operation to start feeding of label sheet 2. As described above, when the controller 23 stops the operation of feed roller 5 in response to a detection signal supplied from the detector 27 which detects the registration mark 26 on the label sheet 2, the label sheet 2 extends a predetermined length beyond the rotary cutter 7. Thereafter, the rotary cutter 7 is driven to rotate continuously thereby cutting the continuous label sheet 2 into a cut sheet of label having a desired length. Then, the before-mentioned initial condition is reestablished and the same process follows in a cyclic manner.

In accordance with the present invention as described above, it is so structured that the feed roller 5 supplies the label sheet 2 to the rotary cutter 7 at an arbitrarily determined velocity independently of the operating speed of the rotary cutter 7 and that even if the rotary cutter 7 is operated at its maximum speed, the label sheet 2 may be supplied over a predetermined length beyond the rotary cutter 7 during a time period between the two consecutive operations of label sheet 2 by the rotary cutter 7. As a result, the feed roller 5 may supply a predetermined length of label sheet 2 to the rotary cutter 7 at all times without being adversely affected by the operating conditions of the other components such as the rotary cutter 7 and the mechanism for transporting the containers 10.

The illustrated embodiment is also advantageous in that the desired length of cut sheet of label may be easily and securely changed just by altering the value of count to be set in the controller 23 in correspondence with the desired length $X_0$.

In the illustrated embodiment, it is so structured that the rotary cutter 7 is associated in driving with the mechanism for transporting containers 10. Alternatively, it may be so structured that the rotary cutter 7 is associated in driving with the feed roller 5 and thus the second motor 22. In such an alternative structure, the rotary cutter 7 is driven intermittently in synchronism with the feed roller 5 so that upon cutting of the label sheet 2 by the rotary cutter 7 after the feed roller 5 has supplied the label sheet 2 to the rotary cutter 7 over a predetermined length, both of the rotary cutter 7 and the feed roller 5 should stop their operations.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A labeling machine for labeling containers one by one comprising:

container transporting means for transporting containers to be labeled along a predetermined container transportation path;

supplying means for supplying a label sheet of continuous length from a storage intermittently over a predetermined length;

rotary cutting means for cutting said label sheet of continuous length thereby producing a cut sheet of label of desired length;

application means for affixing said cut sheet of label to one of said containers;

first driving source for driving at least said container transporting means;

second driving source, independent of said first driving source, for driving said supplying means;

a first detector for producing output signals upon detecting a registration mark provided on said label sheet of continuous length; and a controller responsive to said output signals supplied from said first detector comprising an adjustable circuit means integral therewith for counting a given predetermined distance from said registration mark to a severing position where said label may be cut, said controller being adapted for stopping the operation of said supplying means upon counting of a predetermined count thereby providing said cut sheet of label of desired length when cut by said cutting means.

2. The labeling machine of claim 1 further comprising a second detector disposed adjacent to said rotary cutting means for supplying a second detection signal indicative of the cutting of said label sheet by said cutting means to said controller to thereby activate said feed roller to initiate renewed feeding of said label sheet.

3. The labeling machine of claim 2 further comprising a third detector disposed at an appropriate position along said predetermined container transportation path for supplying a third detection signal indicative of presence or absence of said containers to said controller.

4. The labeling machine of claim 3 further comprising a printing device disposed to print desired data on said label sheet as supplied from said storage.

5. The labeling machine of claim 4 wherein said label sheet of continuous length is stored in the form of roll in said storage.

6. The labeling machine of claim 1 wherein said container transporting means includes a conveyor belt extending along said container transportation path and a star wheel rotatably supported and disposed at an appropriate position along said container transportation path, said star wheel being provided with notches along its periphery at predetermined intervals whereby said notches come into engagement with the containers standing on said conveyor belt to place them spaced apart one from another at a predetermined pitch.

7. The labeling machine of claim 6 wherein said supplying means includes a feed roller which is driven to rotate intermittently by said second driving source to supply said label sheet intermittently to said cutting means over said predetermined length.

8. The labeling machine of claim 7 wherein said application means includes an application drum which is rotatably supported and driven to rotate by said first driving means, said application drum causing said cut sheet of label to be attracted by suction to its peripheral surface with a front surface of said cut sheet of label facing said peripheral surface.

9. The labeling machine of claim 8 wherein said application means further includes a glue applying device disposed adjacent to said application drum for applying glue to the back surface of said cut sheet of label attracted to said application drum by suction.

10. The labeling machine of claim 9 further comprising a first pressure pad disposed downstream of said star wheel as spaced apart from said application drum over a predetermined distance so that said containers are transported through this portion of said container transportation path as rolling along said first pressure pad thereby allowing to securely place said cut sheet of label around the corresponding container.

11. The labeling machine of claim 10 further comprising a second pressure pad disposed downstream of said first pressure pad extending along one side of said conveyor belt and an endless belt disposed along the other side of said conveyor belt as opposed to said second pressure pad so that said containers are transported through this portion of said container transportation path as rolling along said second pressure pad thereby allowing to place said cut sheet of label firmly attached to the corresponding container.

12. The labeling machine of claim 1 wherein said first driving source is connected to drive said rotary cutting means synchronously and said application means as well.

13. The labeling machine of claim 1 wherein said first driving source is connected to drive said application means as well and said second driving source is connected to synchronously drive said rotary cutting means as well.

14. The labeling machine of claim 1 wherein said second driving source includes a motor selected from the group consisting of a stepping motor, servo motor and a pulse motor.

* * * * *